US007526988B2

(12) United States Patent
Elder

(10) Patent No.: US 7,526,988 B2
(45) Date of Patent: May 5, 2009

(54) ELECTROMAGNETIC RAILGUN PROJECTILE

(75) Inventor: Douglas J. Elder, St. Charles, MO (US)

(73) Assignee: The Boeing Company, Chicago, IL (US)

( * ) Notice: Subject to any disclaimer, the term of this patent is extended or adjusted under 35 U.S.C. 154(b) by 336 days.

(21) Appl. No.: 11/432,575

(22) Filed: May 11, 2006

(65) Prior Publication Data

US 2007/0261543 A1 Nov. 15, 2007

(51) Int. Cl.
*F41F 1/00* (2006.01)

(52) U.S. Cl. ..... 89/8; 244/3; 244/3.24; 102/514

(58) Field of Classification Search ..... 89/8; 244/3, 3.24; 102/501–521; 344/3.24
See application file for complete search history.

(56) References Cited

U.S. PATENT DOCUMENTS 2,926,611 A * 3/1960 Hinman, Jr. ..... 102/208
3,976,266 A * 8/1976 Fieuzal et al. ..... 244/3.21
4,327,884 A * 5/1982 Lawhorn ..... 244/3.1
4,572,964 A 2/1986 Honig ..... 307/106
4,885,974 A 12/1989 Honig ..... 89/8
5,393,011 A * 2/1995 Dunn et al. ..... 244/3.21
5,423,497 A * 6/1995 Ransom ..... 244/3.22
6,886,773 B2 * 5/2005 Peckham et al. ..... 244/1 TD
7,252,263 B1 * 8/2007 Hagemeister et al. ..... 244/1 R
2004/0021040 A1 * 2/2004 Redding et al. ..... 244/162
2005/0229806 A1 * 10/2005 Johnsson ..... 102/490
2006/0071120 A1 * 4/2006 Selin et al. ..... 244/3.27
2008/0006144 A1 * 1/2008 Gaigler et al. ..... 89/8
2008/0029642 A1 * 2/2008 Harnisch et al. ..... 244/3.28

FOREIGN PATENT DOCUMENTS

JP 05231797 A * 9/1993

OTHER PUBLICATIONS

Article entitled "The First Generation in the Development and Testing of Full-Scale Electric Gun-Launched, Hypervelocity Projectiles," by Douglas J. Elder, Apr. 8, 1996, 10 pages.

* cited by examiner

*Primary Examiner*—Michael Carone
*Assistant Examiner*—Samir Abdosh
(74) *Attorney, Agent, or Firm*—Evan Law Group LLC

(57) ABSTRACT

An electromagnetic railgun projectile is disclosed which includes an aeroshell having a substantially flat surface extending along the length thereof. The substantially flat surface is configured to increase the lift-to-drag ratio of the projectile during reentry. The projectile also includes an armature integrated into the aeroshell substantially near the center-of-gravity of the projectile, and a plurality of extendable flaps attached to the aeroshell. The flaps are capable of stabilizing the projectile during an unguided portion of its flight and maneuvering the projectile during a guided portion of its flight.

18 Claims, 6 Drawing Sheets

ELECTROMAGNETIC RAILGUN PROJECTILE

BACKGROUND

The present application is directed to electromagnetic railguns, and more particularly to projectiles launched from electromagnetic railguns.

Electromagnetic railguns utilize an electromagnetic force called the Lorentz force to propel an electrically conductive integrated launch package (ILP). In a typical electromagnetic railgun, the ILP slides between two parallel rails and acts as a sliding switch or electrical short between the rails. By passing a large electrical current down one rail, through the ILP, and back along the other rail, a large magnetic field is built up behind the ILP, accelerating it to a high velocity by the force of the current times the magnetic field. An electromagnetic railgun is capable of launching an ILP to velocities greater than fielded powder guns, thereby achieving greater ranges and shorter flight times to engagement.

An ILP typically includes three subsystems: (1) the armature; (2) the sabot; and (3) the projectile. The armature and sabot often comprise about 30- to 50-percent of the total ILP mass. However, these components are traditionally only used during the launch process and are immediately discarded after bore disengagement. Thus, the projectile, which includes the lethality mechanism among other components, often comprises only about 50- to 70-percent of the total ILP mass. Accordingly, one drawback associated with electromagnetic railguns is that insufficient lethality mass is delivered to the target when compared with conventional powder guns and tactical missiles.

In addition, for launch velocities greater than about 2.2 km/s, the armature can transition, thereby inducing undesirable in-bore lateral loads to the ILP and reducing rail life. By reducing launch velocity (e.g., to about 1.7 km/s), heavier ILPs can be launched without experiencing armature transition. However, this approach results in a reduced engagement range for the electromagnetic railgun.

BRIEF DESCRIPTION

The above-mentioned drawbacks associated with existing electromagnetic railgun systems are addressed by embodiments of the present invention, which will be understood by reading and studying the following specification.

In one embodiment, an electromagnetic railgun projectile comprises an aeroshell having an aerodynamic lifting surface extending along the length thereof, an armature integrated into the aeroshell substantially near the center-of-gravity of the projectile, and a plurality of extendable flaps attached to the aeroshell.

In another embodiment, an electromagnetic railgun projectile comprises a non-axisymmetric aeroshell having a substantially flat aerodynamic lifting surface extending along the length thereof. The lifting surface is configured to increase the lift-to-drag ratio of the electromagnetic railgun projectile during reentry.

In another embodiment, an electromagnetic railgun projectile comprises an aeroshell and an armature integrated into the aeroshell substantially near the center-of-gravity of the electromagnetic railgun projectile. The projectile further comprises an insulator substantially surrounding the armature within the aeroshell.

In another embodiment, a method of controlling a projectile during flight is disclosed, in which the projectile has extendable flaps. The method comprises extending the flaps to a first position to stabilize the projectile during an unguided portion of its flight. The method further comprises acquiring a guidance signal that provides the projectile with a desired destination, and utilizing the flaps to maneuver the projectile to the desired destination during a guided portion of its flight.

These and other embodiments of the present application will be discussed more fully in the detailed description. The features, functions, and advantages can be achieved independently in various embodiments of the present application, or may be combined in yet other embodiments.

DRAWINGS

Like reference numbers and designations in the various drawings indicate like elements.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that various changes may be made without departing from the spirit and scope of the present invention. The following detailed description is, therefore, not to be taken in a limiting sense.

Figure 1:
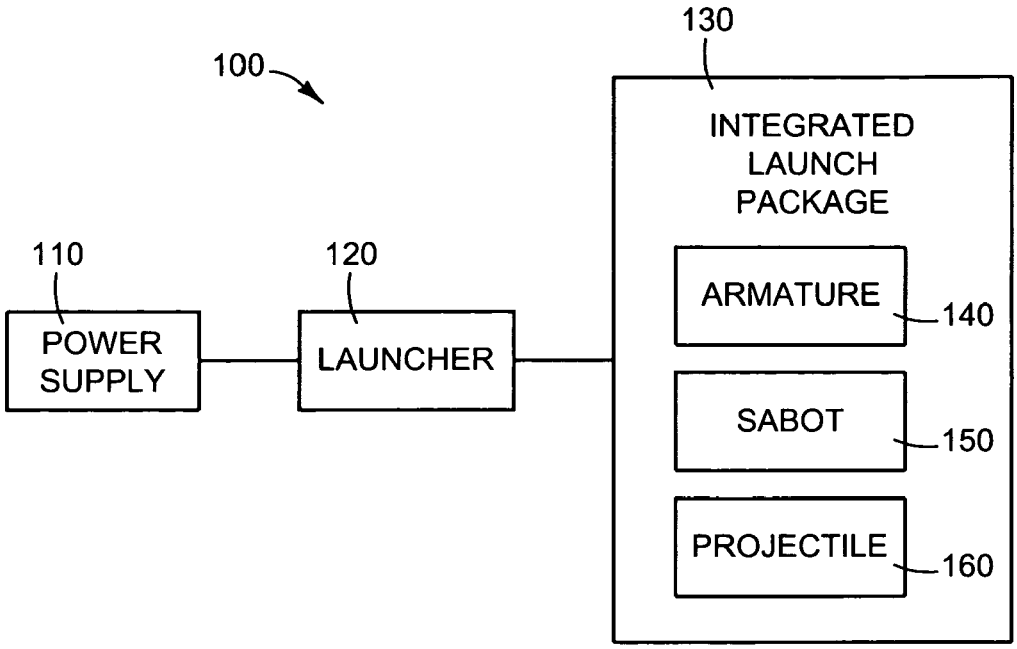
FIG. 1 (Prior Art)
FIG. 1 is a block diagram of an electromagnetic railgun system.

FIG. 1 is a block diagram of a conventional electromagnetic railgun system 100. In the illustrated embodiment, the system 100 comprises a power supply 110 coupled to a launcher 120, which cooperates with a conventional integrated launch package (ILP) 130, as described below. In some embodiments, the power supply 110 comprises a pulsed power supply with a pulse energy ranging from about 60 MJ to about 200 MJ. In these embodiments, the launcher 120 can achieve launch velocities of about 2.5 km/s for ILPs 130 with masses ranging from about 6 kg to about 20 kg.

The conventional ILP 130 includes an armature 140, a sabot 150 and a conventional projectile 160. As known to those of skill in the art, the armature 140 may comprise a variety of suitable devices, such as, for example, a solid armature, plasma armature, or hybrid armature. In addition, the sabot 150 may comprise a variety of suitable configurations, such as, for example, a base-pushing sabot or a mid-riding sabot.

Figure 2:
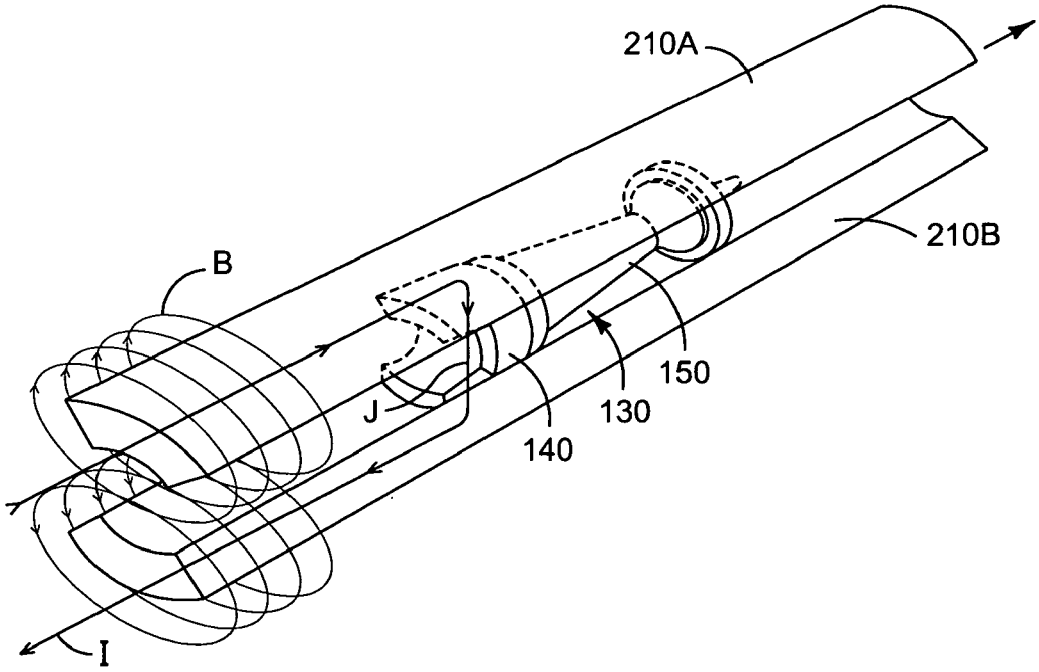
FIG. 2 (Prior Art)
FIG. 2 is a schematic illustrating the operation of an electromagnetic railgun.

As illustrated in FIG. 2, the launcher 120 includes two parallel conductive rails 210A-B which are used to propel the ILP 130 during the launch process. In operation, when the ILP 130 is inserted between the rails 210A-B, it completes an electrical circuit including the power supply 110, the rails 210A-B, and the ILP 130. When this circuit is complete, a driving current, I, flows through the rails 210A-B, and an armature current, J, flows through the armature 140 of the ILP 130. The driving current, I, creates a magnetic field, B, in the region of the rails 210A-B up to the position of the armature 140. This magnetic field, B, interacts with the armature current, J, to produce a Lorentz force having a magnitude of J×B, which accelerates the ILP 130 along the rails 210A-B.

Frequently, the driving current, I, is large enough to produce a strong Lorentz force that is capable of launching the ILP 130 to velocities much greater than fielded powder guns. Thus, in many applications, electromagnetic railguns are preferable to powder guns because powder guns are limited in muzzle energy and launch velocity. In addition, electromagnetic railguns are often preferable to tactical missiles, because missiles are limited in stowed capability and lack the firepower of guns.

Nevertheless, there are a number of drawbacks associated with existing electromagnetic railguns. For example, in the conventional ILP 130 illustrated in FIGS. 1 and 2, the armature 140 and sabot 150 comprise about 30- to 50-percent of the total ILP mass, which is immediately discarded after the ILP 130 exits the launcher 120. The remaining 50- to 70-percent of the ILP mass (e.g., between about 3- and 14-kg) is allocated to the conventional projectile 160, which typically includes an aeroshell structure, a lethality mechanism, and a guidance, navigation and control system (not shown). Therefore, when using a conventional ILP 130, the electromagnetic railgun system 100 delivers less lethality mass to a given target when compared with conventional powder guns and tactical missiles.

In addition, while electromagnetic railguns generally are capable of longer firing ranges than fielded powder guns, it is difficult to launch a conventional ILP 130 to a target at long range (e.g., about 400 km) without experiencing undesirable side effects. For example, using a conventional ILP 130, a long range launch typically requires a high launch energy (e.g., about 200 MJ) and launch velocity (e.g., about 2.2 km/s or greater). However, when launching a conventional ILP 130 at such a high velocity, the armature 140 can transition, thereby inducing undesirable in-bore lateral loads to the ILP 130 and reducing the life of the rails 210A-B.

The systems and methods described herein address these and other drawbacks of existing electromagnetic railgun systems. For example, using the systems and methods described herein, the lethality mass delivered to a target by an electromagnetic railgun projectile can be significantly increased, while holding launch energy constant to significantly reduce or eliminate in-bore armature transition and aeroshell reentry ablation. In some embodiments, this lethality mass can be increased by an order of about 2- to 3-times over conventional ILPs 130. In addition, using the systems and methods described herein, existing throw-away (parasitic) mass can be converted to useful structure/lethality mass, while maintaining the range for the resultant heavier projectile. These systems and methods also enable a projectile to be statically stable during unguided, high-altitude flight and to be maneuverable during guided, low-altitude flight.

FIGS. 3-5 are schematics illustrating an electromagnetic railgun projectile 300 in accordance with one embodiment of the present application. In the illustrated embodiment, the projectile 300 comprises an aeroshell 310 having an integrated armature 320, a plurality of extendable flaps 330, and a guidance, navigation, and control system 370. Those of ordinary skill in the art will understand that the projectile 300 may comprise a variety of alternative or additional components, which are not illustrated in FIGS. 3-5 for simplicity.

Figure 3A:
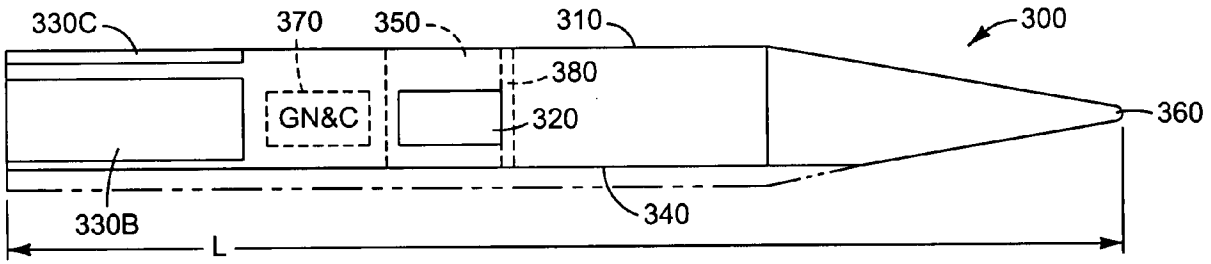
FIGS. 3-5 are schematics illustrating an electromagnetic railgun projectile in accordance with one embodiment of the present application.
Figure 3B:
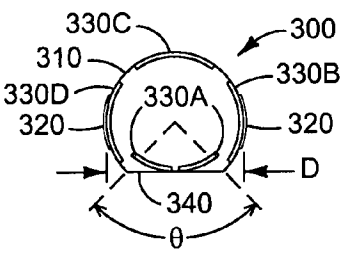
Figure 4A:
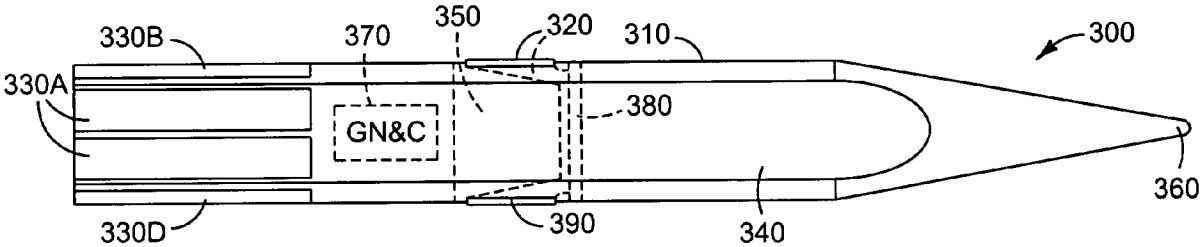
Figure 4B:
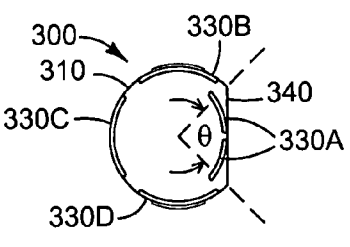
Figure 5A:
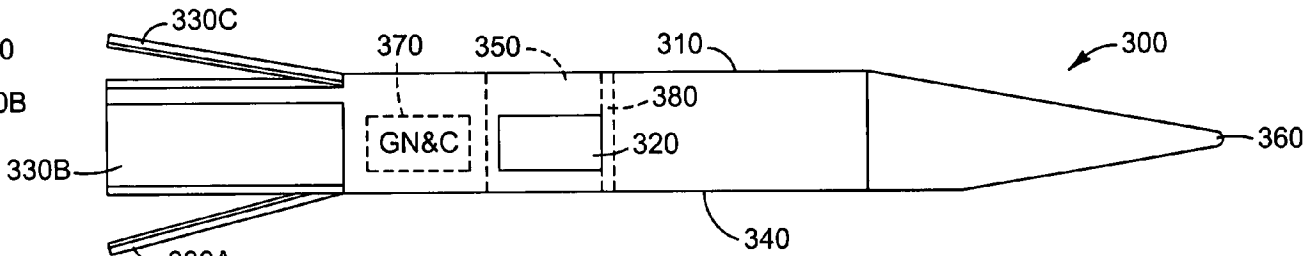
Figure 5B:
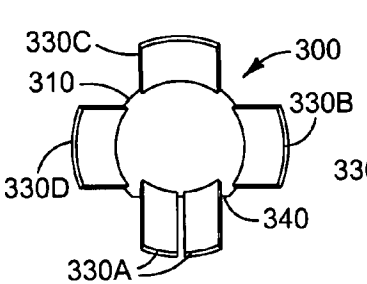

FIG. 3A is a side view of the projectile 300 from a first side with the flaps 330 retracted, and FIG. 3B is a rear view of the projectile 300 while oriented at the angle shown in FIG. 3A. FIG. 4A is a bottom view of the projectile 300 with the flaps 330 retracted, and FIG. 4B is a rear view of the projectile 300 while oriented at the angle shown in FIG. 4A. FIG. 5A is a side view of the projectile 300 from the first side with the flaps 330 extended, and FIG. 5B is a rear view of the projectile 300 while oriented at the angle shown in FIG. 5A.

The projectile 300 can be fabricated using a variety of materials and techniques that are familiar to those of ordinary skill in the art. For example, in some embodiments, the projectile 300 comprises a carbon-carbon nosetip 360, and the aeroshell 310 is fabricated from a composite material (e.g., graphite-glass/epoxy) or a suitable metal, such as steel (e.g., VASCOMAX® steel), tungsten, titanium, or other suitable alloy(s).

Figure 9A:
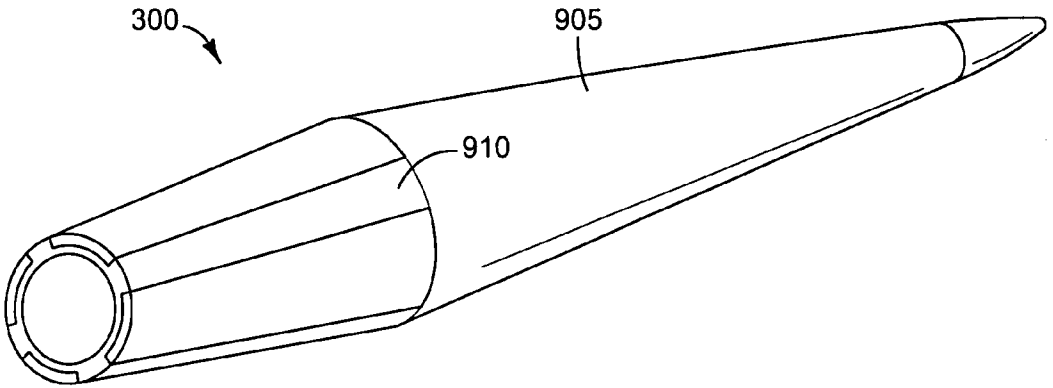
FIGS. 9A and 9B are perspective views of an electromagnetic railgun projectile.
Figure 9B:
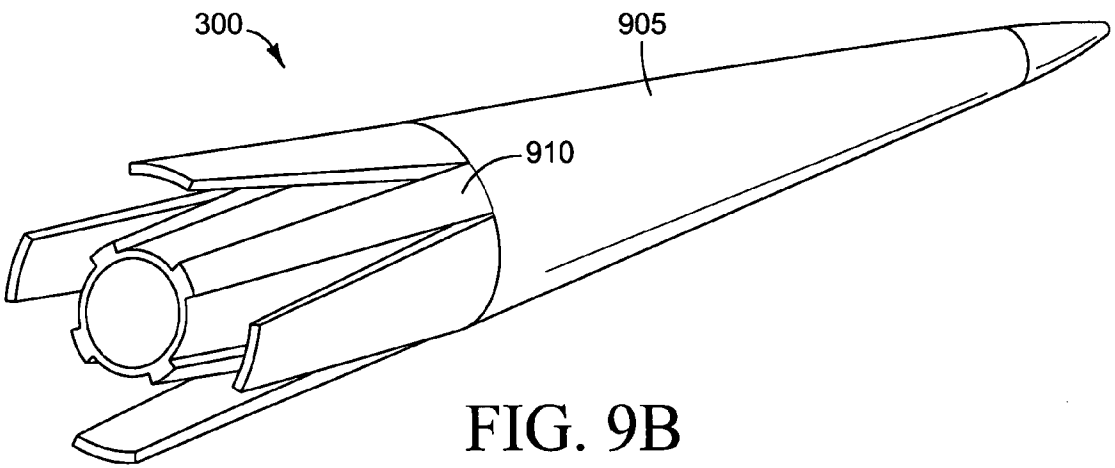

In some embodiments, the projectile 300 has a length, L, ranging from about 36 inches to about 40 inches, and a cross-sectional diameter, D, of about 4 inches. In the embodiment illustrated in FIGS. 3-5, the aeroshell 310 has a constant diameter, D, throughout its length. In other embodiments, the aeroshell 310 may have a different configuration, such as, for example, a conic or power-law fore-body 905 and a boat-tail aft-body 910, as shown in FIG. 9. In some embodiments, the projectile 300 has a mass ranging from about 6 kg to about 20 kg, and can reach targets at a range of about 400 km while launched at a velocity of about 1.7 km/s or less.

As illustrated in FIGS. 3-5, the aeroshell 310 is raked off along the bottom, resulting in a substantially flat lower surface 340. Therefore, the aeroshell 310 does not have the axisymmetric, bi-conic geometry indicated by the phantom line shown in FIG. 3A, which is commonly implemented in conventional projectiles 160. Rather, the aeroshell 310 is non-axisymmetric, having a substantially flat, aerodynamic lifting surface 340 extending along the length of the aeroshell 310. As described below, this surface 340 advantageously enables the range of the projectile 300 to be significantly extended without increasing launch energy and velocity.

Figure 6:
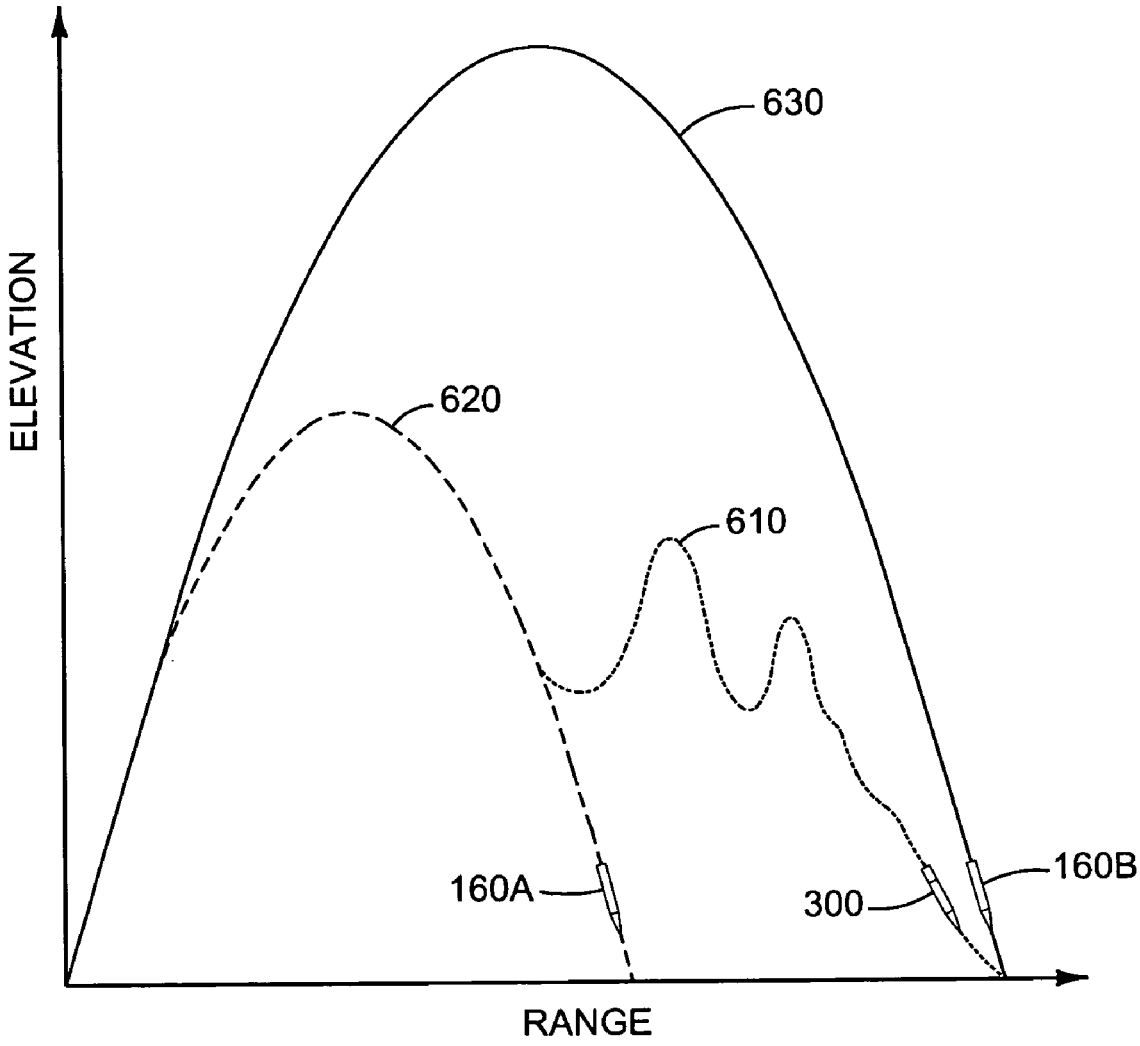
FIG. 6 is a graph illustrating the flight paths of various electromagnetic railgun projectiles.

FIG. 6 illustrates an exemplary flight path 610 of a projectile 300 with a substantially flat lower surface 340, as compared to a typical flight path 620 of a relatively heavy conventional projectile 160A, as well as a typical flight path 630 of a relatively light conventional projectile 160B. As illustrated, a conventional projectile 160 having an axisymmetric, bi-conic geometry will generally follow a standard ballistic trajectory, shown as flight paths 620, 630 in FIG. 6. One factor affecting the range of a conventional projectile 160 following such a trajectory is the initial launch energy, which can be determined by the following equation:

$$E = \frac{1}{2}(M_{ILP})(V_L)^2.$$

In this equation, E is the launch energy, $M_{ILP}$ is the mass of the ILP 130, and $V_L$ is the launch velocity. In the examples illustrated in FIG. 6, the launch energy, E, is the same for each of the projectiles whose flight paths are shown. Assuming constant launch energy, E, conventional projectiles 160 frequently require a tradeoff between lethality mass and range. For example, while the first conventional projectile 160A shown in FIG. 6 delivers more lethality mass to the target, the second conventional projectile 160B is launched at a greater velocity and thus has a greater range than the first conventional projectile 160A.

Unlike a conventional projectile 160, the projectile 300 having a substantially flat lower surface 340 does not follow a standard ballistic trajectory. Rather, the projectile 300 experiences a series of lifting trajectories during descent by pulling its nose up and then nosing down, as shown in FIG. 6. In some embodiments, these lifting trajectories occur during reentry (e.g., below about 120 kft) by having the projectile 300 pull angle of attack by deflection of the flaps 330.

A primary reason that the projectile 300 can experience lifting trajectories during descent is that the substantially flat lower surface 340 can significantly increase the lift-to-drag ratio of the projectile 300. In some embodiments, the lower surface 340 is raked off at an angle, θ, of about 60°, and the lift-to-drag ratio of the projectile 300 during reentry is about four. In other embodiments, the lower surface 340 can be raked off at a different angle, and the lift-to-drag ratio of the projectile 300 can be adjusted to a different desired amount.

As shown in FIG. 6, the lifting trajectories of the projectile 300 advantageously enable it to achieve a significantly greater range than a conventional projectile 160A having the same mass and launched at the same launch energy and velocity. Therefore, the launch velocity of the projectile 300 can advantageously be reduced (e.g., to about 1.7 km/s), without sacrificing lethality payload mass or engagement range. As discussed above, reduced launch velocities advantageously enable armature transition to be substantially reduced or eliminated, in-bore ballistics to be improved, and rail life to be significantly extended.

Referring again to FIGS. 3-5, the projectile 300 comprises an armature 320, which is integrated into the aeroshell 310 near the center-of-gravity of the projectile 300. This configuration differs from that of a conventional ILP 130, in which the armature 140 is typically located behind the sabot 150, as shown in FIG. 2, and is immediately discarded after bore disengagement. By integrating the armature 320 into the aeroshell 310, this conventional parasitic mass is advantageously converted into usable structural and lethality mass.

The armature 320 can be integrated into the aeroshell 310 using a variety of techniques that are well-known and well-understood by those of ordinary skill in the art. For example, in some embodiments, the armature 320 is integrated into the aeroshell 310 as a key internal structural member between the fore-body and aft-body (e.g., similar to a bulkhead). In these embodiments, the forward end of the armature 320 directs the driving forces back into the aeroshell 310 through an internal pusher-plate 380 in a manner similar to a base-pushing sabot, but also distributes the forces in the aeroshell 310 in a manner similar to a mid-riding sabot. The two outer surfaces of the armature 320 protrude through holes 390 in the aeroshell 310 to make contact with the rails.

In the illustrated embodiment, the armature 320 is substantially surrounded by an insulator 350 to insulate other components of the projectile 300 from the armature current, J, which flows through the armature 320 during the launch process. In some embodiments, the insulator 350 comprises a high-strength, high-temperature plastic, such as, for example, NYLATRON® or LEXAN®.

In some embodiments, the armature 320 is fabricated from aluminum, whereas in other embodiments, the armature 320 is fabricated from a material that is heavier than aluminum, such as, for example, copper, silver-infiltrated tungsten, or copper-infiltrated tungsten. The choice of material for the armature 320 can be optimized to substantially reduce or eliminate ablation based on factors such as launch performance and reentry temperatures.

Another advantage associated with integrating the armature 320 into the aeroshell 310 is that the sabot design can be simplified dramatically. For example, in some embodiments, the "sabot" used in connection with the projectile 300 during launch comprises simply a forward and aft bore-rider fabricated from an insulator material, such as NYLATRON® or LEXAN®. Such a simplified sabot design advantageously enables a significant reduction in the parasitic, throw-away mass typically associated with sabots 150 in conventional ILPs 130.

Referring again to FIGS. 3-5, the projectile 300 comprises a plurality of extendable flaps 330, which can act as control surfaces capable of both extending into and out of the flow field during the flight of the projectile 300. In the illustrated embodiment, the aft-body of the projectile 300 comprises four flaps 330; the bottom flap 330A is split into two parts to control the roll of the projectile 300. In other embodiments, a different number of flaps 330 can be utilized, and the flaps 330 can be arranged in different configurations.

In some embodiments, when the flaps 330 are deflected outwards, the projectile 300 has a statically stable, tri-conic geometry with a static-margin greater than about 10%. On the other hand, when the flaps 330 are deflected inwards, the projectile 300 has a near neutral-stable, bi-conic geometry with a static-margin approaching 0%. Therefore, as described below, the flaps 330 can advantageously be operated during both unguided and guided phases of an endoatmospheric/exoatmospheric/endoatmospheric flight of a projectile 300.

In operation, the flaps 330 can be extended and retracted using a variety of suitable actuation mechanisms. For example, in some embodiments, the motion of each flap 330 is controlled via a push-pull rod (not shown) connecting the inside of the flap 330 to an actuator located inside the projectile 300. A variety of other suitable actuation mechanisms are known to those of skill in the art.

Figure 7:
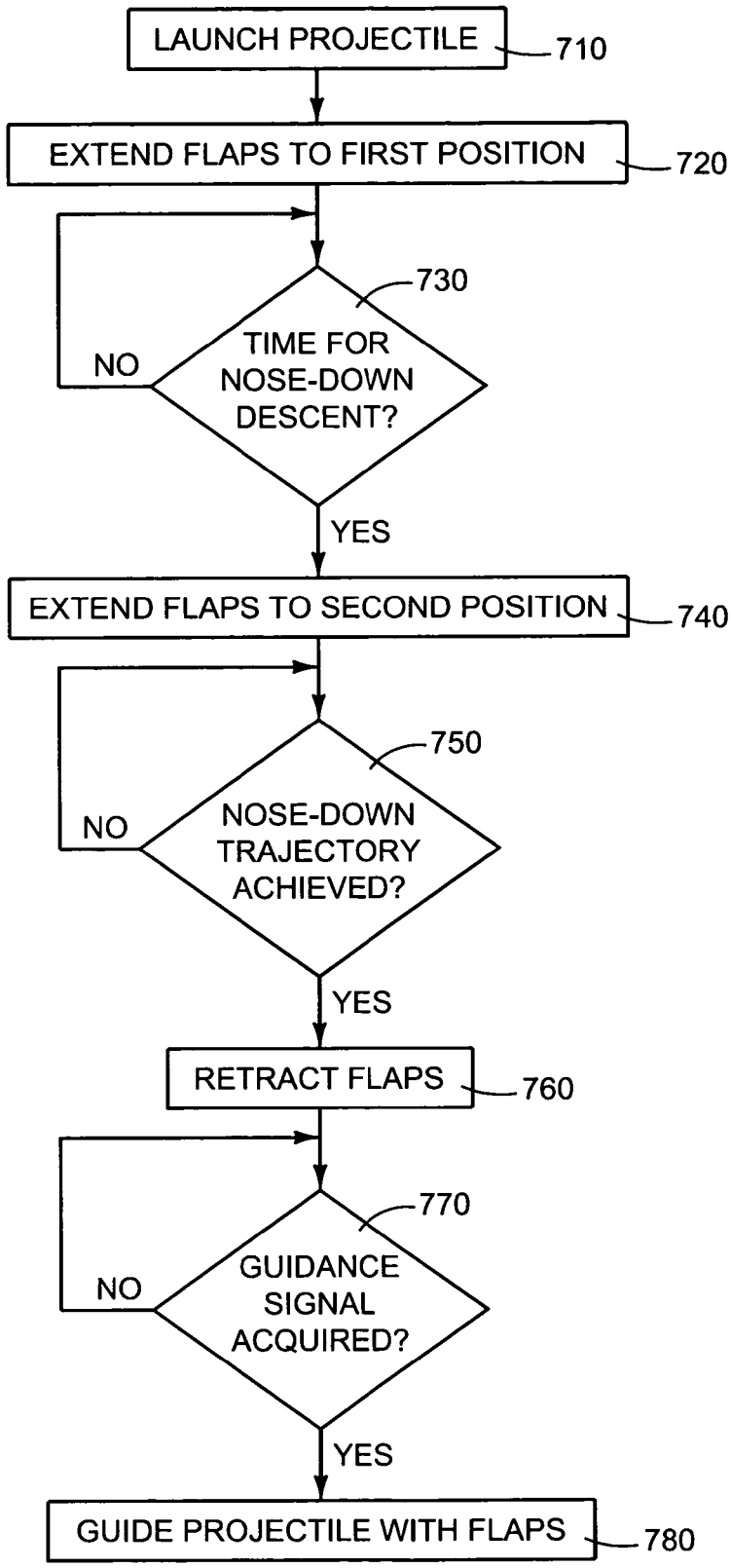
FIG. 7 is a flow diagram illustrating the operation of flaps on an electromagnetic railgun projectile during the flight of the projectile.

FIG. 7 is a flow diagram illustrating the operation of the flaps 330 during an exemplary flight of a projectile 300. At a first block 710, the projectile 300 is launched, and at a second block 720, the flaps 330 are extended to a first position to provide unguided stability the projectile 300. The flaps 330 often remain in the first position throughout the ascent of the projectile 300 and after apogee, prior to reaching denser air (e.g., at about 36 km). In some embodiments, when the flaps 330 are extended to the first position, they are slightly extended only several degrees from the aeroshell 310, as shown by projectiles 300B and 300C in FIG. 8.

Figure 8:
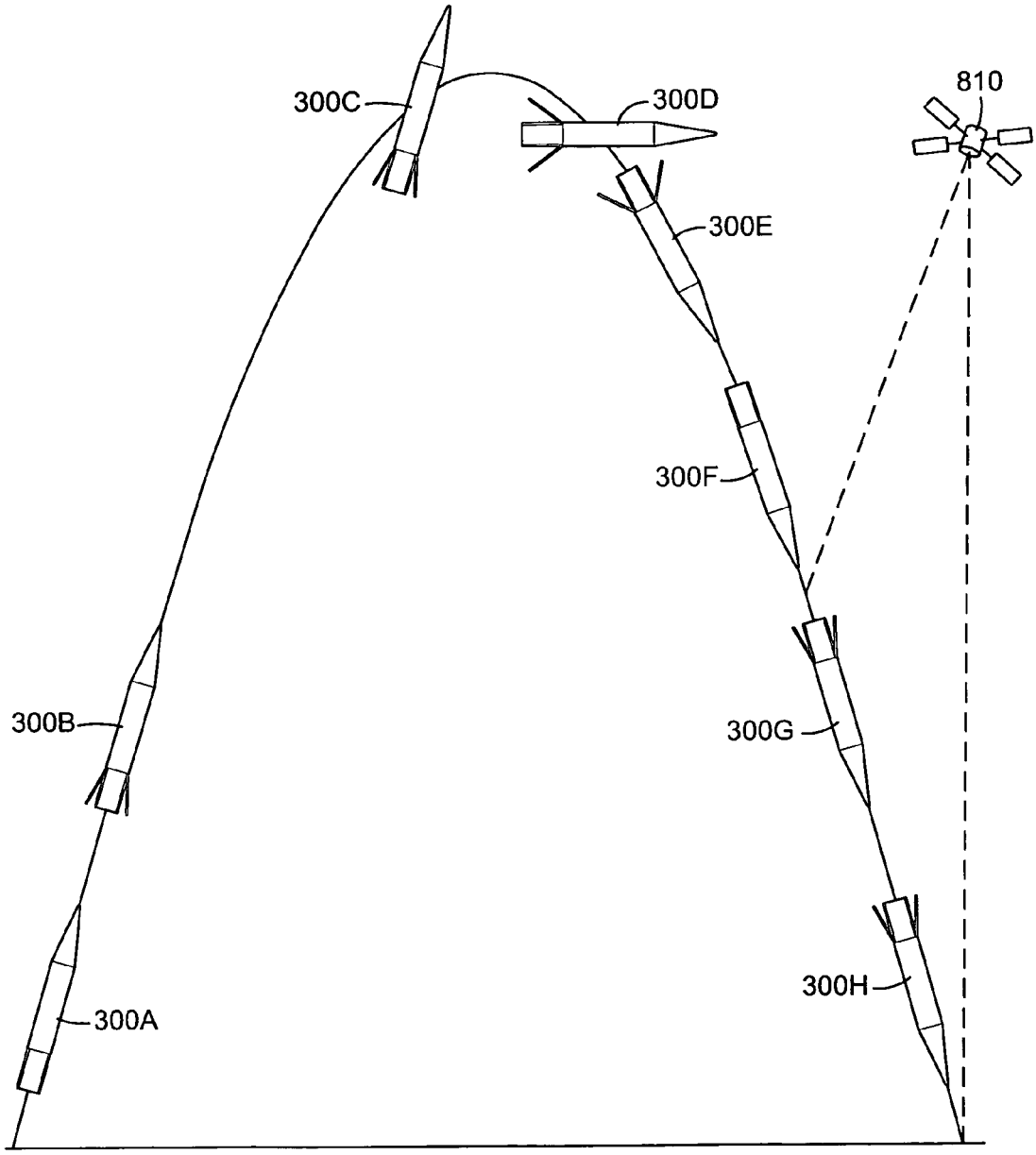
FIG. 8 is a graph illustrating the state of an electromagnetic railgun projectile during various stages of its flight.

Referring again to FIG. 7, at a decision block 730, a determination is made as to whether it is time for the projectile 300 to make a nose-down descent. In some embodiments, the projectile 300 begins a nose-down descent upon reentry shortly after reaching apogee, as shown in FIG. 8. In other embodiments, the projectile 300 begins a nose-down descent after experiencing a series of lifting trajectories by pulling its nose up and then nosing down, as shown in FIG. 6. Once it is time to make a nose-down descent, at a block 740, the flaps 330 are extended to a second position to orient the projectile 300 in a nose-down trajectory. In some embodiments, when the flaps 330 are extended to the second position, they are fully extended from the aeroshell 310, as shown by projectiles 300D and 300E in FIG. 8.

At a decision block 750, a determination is made as to whether the projectile 300 has achieved the desired nose-down trajectory. If so, then at a block 760, the flaps 330 are retracted into a low drag profile to increase the velocity of the projectile 300, as shown by projectile 300F in FIG. 8.

At a decision block 770, a determination is made as to whether the projectile 300 has acquired a guidance signal from an appropriate source, such as, for example, a GPS satellite 810, as shown in FIG. 8. Once a guidance signal has been acquired, then at a block 780, the flaps 330 are used to guide the projectile 300 to its destination, as shown by projectiles 300G and 300H in FIG. 8. In some embodiments, the flaps 330 are designed to move away from rather than into the flow field to maneuver the projectile 300 during the guided portion of its flight, thereby resulting in lower heating rates and drag.

As described above, the projectile 300 exhibits a number of distinct advantages over conventional electromagnetic railgun ILPs 130. For example, the projectile 300 has a lifting body configuration with a larger payload section than a conventional ILP 130. In addition, the projectile 300 has less throw-away (parasitic) mass than a conventional ILP 130, and has extendable flaps 330 capable of operating during both unguided and guided flight. Accordingly, the projectile 300 enables greater standoff distances to be achieved and greater lethality mass to be delivered on target, when compared with a conventional axisymmetric ballistic projectile 160 launched at the same muzzle energy.

Although this invention has been described in terms of certain preferred embodiments, other embodiments that are apparent to those of ordinary skill in the art, including embodiments that do not provide all of the features and advantages set forth herein, are also included within the scope of this invention. Accordingly, the scope of the present invention is defined only by reference to the appended claims and equivalents thereof.

What is claimed is:

1. An electromagnetic railgun projectile comprising:

a non-axisymmetric aeroshell having an aerodynamic lifting surface extending along a length thereof for increasing a range of the projectile;

a armature integrated into the aeroshell near the center-of-gravity of the projectile; and a plurality of flaps attached to the aeroshell, wherein the flaps are extendable and retractable during flight away from and towards the aeroshell and into and out of a flow field of the projectile in order to control a path of the projectile during flight, wherein the armature is for passing current from one electromagnetic rail through the armature to another electromagnetic rail in order to launch the projectile and the aeroshell is defined by holes and surfaces of the armature pass through the holes in order to make contact with the rails.

2. The electromagnetic railgun projectile of claim 1, further comprising an insulator substantially surrounding the armature within the aeroshell.

3. The electromagnetic railgun projectile of claim 1, further comprising a sabot comprising a forward and aft bore-rider fabricated from an insulator.

4. The electromagnetic railgun projectile of claim 1, wherein the flaps are configured to stabilize the projectile during an unguided portion of its flight and to maneuver the projectile during a guided portion of its flight.

5. The electromagnetic railgun projectile of claim 1, wherein the aeroshell comprises a conic or power-law fore-body and a boat-tail aft-body.

6. The electromagnetic railgun projectile of claim 1, having a mass ranging from 6 kg to about 20 kg.

7. The electromagnetic railgun projectile of claim 1, further comprising a guidance, navigation and control system.

8. An electromagnetic railgun projectile comprising:

a non-axisymmetric aeroshell;

an armature integrated into the aeroshell substantially near the center-of-gravity of the electromagnetic railgun projectile, wherein the armature is for passing current from one electromagnetic rail through the armature to another electromagnetic rail in order to launch the projectile; and an insulator substantially surrounding the armature within the aeroshell in order to insulate other components of the projectile from current passing through the armature during launch of the projectile, wherein the aeroshell is defined by holes and surfaces of the armature pass through the holes in order to make contact with the rails.

9. The electromagnetic railgun projectile of claim 8, wherein the armature comprises aluminum, copper, silver-infiltrated tungsten or copper-infiltrated tungsten.

10. The electromagnetic railgun projectile of claim 8, wherein the insulator comprises a high-strength, high-temperature plastic.

11. The electromagnetic railgun projectile of claim 8, further comprising a sabot comprising a forward and aft bore-rider fabricated from an insulator.

12. The electromagnetic railgun projectile of claim 1 wherein the aerodynamic lifting surface is substantially flat.

13. (The electromagnetic railgun projectile of claim 1 wherein the integrated armature remains attached to the aeroshell during an entire flight of the projectile.

14. The electromagnetic railgun projectile of claim 1 wherein an insulator insulates substantially surrounds the armature to insulate other components of the projectile from current passing through the armature during launch of the projectile.

15. The electromagnetic railgun projectile of claim 8 wherein the non-axisymmetric aeroshell has an aerodynamic lifting surface for increasing a range of the projectile.

16. The electromagnetic railgun projectile of claim 8 further comprising a plurality of extendable flaps attached to the aeroshell, wherein the flaps are extendable and retractable during flight away from and towards the aeroshell and into and out of a flow field of the projectile in order to control a path of the projectile during flight.

17. The electromagnetic railgun projectile of claim 15 wherein he aerodynamic lifting surface is substantially flat.

18. The electromagnetic railgun projectile of claim 8 wherein the integrated armature remains attached to the aeroshell during an entire flight of the projectile.

* * * * *